US006601554B1

(12) United States Patent
Schäfer et al.

(10) Patent No.: US 6,601,554 B1
(45) Date of Patent: Aug. 5, 2003

(54) DEVICE FOR VARYING THE VALVE CONTROL TIMES OF AN INTERNAL COMBUSTION ENGINE, ESPECIALLY A CAMSHAFT ADJUSTING DEVICE WITH A PIVOTAL IMPELLER WHEEL

(75) Inventors: Jens Schäfer, Herzogenaurach (DE); Michael Haag, Nürnberg (DE)

(73) Assignee: Ina Walzlager Schaeffler oHG (DE)

( * ) Notice: Subject to any disclaimer, the term of this patent is extended or adjusted under 35 U.S.C. 154(b) by 0 days.

(21) Appl. No.: 10/048,821

(22) PCT Filed: Jul. 7, 2000

(86) PCT No.: PCT/EP00/06472

§ 371 (c)(1),
(2), (4) Date: Apr. 23, 2002

(87) PCT Pub. No.: WO01/11202

PCT Pub. Date: Feb. 15, 2001

(30) Foreign Application Priority Data

Aug. 4, 1999 (DE) ..... 199 36 632

(51) Int. Cl.[7] ..... F01L 1/34

(52) U.S. Cl. ..... 123/90.17; 123/90.18; 123/90.31; 123/90.37

(58) Field of Search ..... 123/90.17, 90.1, 123/90.11–90.18, 90.31, 90.37; 464/2; 74/568 R

(56) References Cited

U.S. PATENT DOCUMENTS 4,858,572 A 8/1989 Shirai et al.
5,836,275 A * 11/1998 Sato ..... 123/90.17
5,836,276 A 11/1998 Iwasaki et al.
6,170,447 B1 * 1/2001 Kohrs et al. ..... 123/90.17
6,283,075 B1 * 9/2001 Schafer et al. ..... 123/90.17

FOREIGN PATENT DOCUMENTS

| | | | |
|---|---|---|---|
| DE | 19715570 | 10/1998 | |
| DE | WO 9943928 | * 9/1999 | ..... F01L/1/344 |
| DE | 19808619 | 9/1999 | |
| EP | 0801212 | 10/1997 | |
| EP | 0845584 | 6/1998 | |

* cited by examiner

*Primary Examiner*—Thomas Denion
*Assistant Examiner*—Kyle Riddle
(74) *Attorney, Agent, or Firm*—Muserlian, Lucas and Mercanti

(57) ABSTRACT

A hydraulic camshaft adjusting device, which comprises a drive wheel (2) and a pivotal impeller wheel (10) connected in a rotationally fixed manner to a camshaft (9), the drive wheel (2) comprises a. cavity formed by a peripheral wall (3) and two lateral walls, in which cavity at least one hydraulic working space (8) is formed by at least two delimitation walls (7) and the pivotal impeller wheel (10) has at least one radial blade (12), and with each blade (12) divides a hydraulic working space (8) into two hydraulic pressure chambers (13, 14), which are sealed off from one another by sealing elements (17) disposed between the drive wheel (2) and the pivotal impeller wheel (10), the pivotal impeller wheel (10) can be mechanically coupled to the drive wheel (2) in a preferred basic position, a locking element (18) disposed on the drive wheel (2) being movable by a spring clement (19) into a complementary seating (20) in the drive wheel (2).

7 Claims, 3 Drawing Sheets

A - A

DEVICE FOR VARYING THE VALVE CONTROL TIMES OF AN INTERNAL COMBUSTION ENGINE, ESPECIALLY A CAMSHAFT ADJUSTING DEVICE WITH A PIVOTAL IMPELLER WHEEL

DESCRIPTION

1. Field of the Invention

The invention relates to a device for varying the valve control times of an internal combustion engine in accordance with the features forming the precharacterizing clause of claim 1, and is particularly advantageously implementable on hydraulic camshaft adjusting devices with pivotal impeller wheel.

2. Background of the Invention

Such a device was generically disclosed by EP 0 845 584 A1. This device, configured as what is known as a pivotal impeller wheel adjusting device, comprises a drive wheel configured as an outer rotor and drive-connected to a crankshaft of the internal combustion engine, which drive wheel comprises a cavity formed by a hollow cylindrical peripheral wall and two lateral walls, within which cavity four hydraulic working spaces are formed by four delimitation walls starting from the inside of the peripheral wall and oriented toward the longitudinal central axis of the drive wheel. The device further comprises a pivotal impeller wheel connected in a rotationally fixed manner to a camshaft of the internal combustion engine and inset into the cavity of the drive wheel, and in turn having on the periphery of its wheel hub four radially disposed, solid blades, which each extend into a working space of the drive wheel and divide the latter into pairs of hydraulic pressure chambers working in opposition to one another. The pressure chambers are sealed off from one another by sealing elements disposed between the free end surface of each blade of the pivotal impeller wheel and the peripheral wall of the drive wheel and between the free end surface of each delimitation wall of the drive wheel and the wheel hub of the pivotal impeller wheel and, when selectively or simultaneously subjected to the action of pressure by means of a hydraulic pressure medium, effect a pivot movement or fixing of the pivotal impeller wheel relative to the drive wheel and hence of the camshaft relative to the crankshaft. When the internal combustion engine is switched off, moreover, the pivotal impeller wheel can be mechanically coupled to the drive wheel, with minimization of the volume of a pressure chamber of each hydraulic working space, in a preferred basic position for the starting of the internal combustion engine, a locking element configured as an axial locking pin being disposed within one of the radial blades of the pivotal impeller wheel or on the drive wheel and being axially movable by a spring element, configured as a helical compression spring, into a coupling position within a complementary seating configured as an axial engagement aperture in a lateral wall of the drive wheel. The axial engagement aperture of the locking pin is hydraulically connected to the pressure medium feed to a pressure chamber of a hydraulic working space of the device, in such a manner that when the internal combustion engine is started, as a result of the subjection to the action of pressure of one pressure chamber of the hydraulic working spaces, the engagement aperture of the locking pin is simultaneously subjected to the action of pressure and as a result of action on its end surface located in the engagement aperture is moved hydraulically into an uncoupling position within the blade of the pivotal impeller wheel.

A further possible form of mechanical coupling between the impeller wheel and the drive wheel of a hydraulic camshaft adjusting device is proposed by the solution disclosed in U.S. Pat. No. 4,858,572. This device, which is of the type known as a vane cell adjusting device and is comparable in structural terms with a pivotal impeller wheel adjusting device but differs therefrom in having lighter blades on the impeller wheel and, in most cases, a larger number of hydraulic working spaces, comprises a total of six hydraulic working spaces, of which the first three working spaces can be subjected to the action of a hydraulic pressure medium only in one direction of rotation and the second three working spaces only in the other direction of rotation. In this device, in contrast to the device described initially, the mechanical coupling of the impeller wheel to the drive wheel of the device in a preferred basic position for the starting of the internal combustion engine is effected by two locking elements configured as radial locking pins, each of which is disposed in a radial bore in two mutually opposite delimitation walls of the drive wheel. These radial locking pins are alternately movable by a spring element configured as a helical compression spring into, in each case, a complementary seating disposed between two blades in the wheel hub of the impeller wheel and configured as a radial receiving bore, when the blades of the impeller wheel, in one of their two end positions, encounter the delimitation walls of the drive wheel, and the first or second working spaces, when the internal combustion engine is switched off, are no longer subject to the action of the pressure of a pressure medium. The radial receiving bores of the locking pins are hydraulically connected to the pressure medium feed to the first three or the second three hydraulic working spaces in a manner such that, within a filling channel to each of the working spaces, they are upstream of the latter in series, so that when the first three or second three working spaces are subjected to the action of pressure the locked locking pin is first subjected to the action of pressure by the pressure medium against the force of its spring element and is moved hydraulically into an uncoupling position within the delimitation wall of the drive wheel, and filling of the hydraulic working spaces is only subsequently possible.

These locking elements, designed in one case as an axial locking pin and in the other as a radial locking pin, for mechanical coupling between the impeller wheel and the drive wheel of a pivotal impeller wheel or vane cell adjusting device have, however, the disadvantage that they are formed from a plurality of individual parts which, in conjunction with necessarily increased production and assembly effort, sometimes substantially increase the cost of a pivotal impeller wheel or vane cell adjusting device configured in this way.

OBJECT OF THE INVENTION

It is an object of the invention to design a device for varying the valve control times of an internal combustion engine, especially a camshaft adjusting device, in which the mechanical coupling between the pivotal impeller wheel and the drive wheel can be achieved with a minimum number of individual parts and a low production effort, and the production and assembly costs of the device can thus be reduced to a minimum.

SUMMARY OF THE INVENTION

According to the invention, this object is achieved with a device in accordance with the preamble of claim 1, in that at least one of the sealing elements between the pivotal impeller wheel and the drive wheel of the device is simultaneously configured as a locking element for the mechanical coupling of the pivotal impeller wheel to the drive wheel of the device.

In an expedient further development of the invention, the pressure chambers of the device are preferably sealed off from one another only by sealing elements disposed between the free end surface of each blade of the pivotal impeller wheel and the peripheral wall of the drive wheel and configured as conventional sealing strips or sealing rolls, of which preferably only one is simultaneously provided as a locking element. Such a sealing of the pressure chambers, in conjunction with their further sealing by sealing joints between the free end surface of each delimitation wall of the drive wheel and the wheel hub of the pivotal impeller wheel, has proven sufficient to meet requirements and, at the same time, cost-effective, an arrangement, of further sealing elements instead of the sealing joints, for example further sealing elements disposed within an axial groove in the free end surface of the delimitation walls, not being ruled out.

However, a particularly preferred embodiment of the sealing elements between the free end surface of the pivotal impeller wheel and the peripheral wall of the drive wheel has proven to be radially movable sealing strips disposed in each case in an axial groove in the free end surface of each blade of the pivotal impeller wheel and configured to be urged via supporting springs with a constant contact pressure against the inside of the peripheral wall of the drive wheel in order to improve leaktightness relative to the pressure medium. In this case, at least the sealing strip simultaneously configured as a locking element has, in a conventional manner, an axial length corresponding to the width of the peripheral wall of the drive wheel but differs from conventional sealing strips disposed in axial grooves in the blades of a pivotal impeller wheel in having a radial height corresponding to approximately half the length of a blade of the pivotal impeller wheel. To reduce the number of different components for the device, however, it is also possible and expedient here to configure not only the sealing strip provided as a locking element but all sealing strips on the pivotal impeller wheel of the device in the manner described.

In another development of the invention, it is proposed, as a first embodiment of a sealing strip locking system, to configure the sealing strip simultaneously configured as a locking element to be axially movable in such a way that, in the coupling position, it is in positive engagement, by one of its lateral surfaces oriented toward the lateral walls of the drive wheel in one or more locking position(s) of the device, with, in each case, one radial fixing groove configured as a complementary seating in the inside of one of the lateral walls of the drive wheel. In most applications, it has proven sufficient here for the sealing strip simultaneously configured as a locking element to be in latching connection with the drive wheel in only one locking position of the device, this one locking position preferably corresponding to one of the two end positions of the pivotal impeller wheel or, after the device has been installed on an input or output camshaft, respectively, to correspond to a camshaft twisted toward "late" or toward "early". The necessary radial fixing groove of the sealing strip is, accordingly, preferably machined into the lateral wall of the drive wheel remote from the camshaft in the vicinity of one of the two delimitation walls of the hydraulic working space of the drive wheel divided by the blade with the locking element and extending radially to the longitudinal axis of the device. Similarly, the scope of protection of the invention is also intended to encompass those solutions in which two or more sealing strips, or alternatively equivalently disposed sealing rollers, are configured as locking elements on the end surfaces of the blades of the pivotal impeller wheel, it being possible for all of these locking elements either to be locked in one end position or alternatively, by providing a further radial fixing groove within each hydraulic working space, to be locked in both end positions of the pivotal impeller wheel. It is also possible to configure one or more sealing strips to be latchable in one end position and one or more sealing strips to be latchable in the other end position of the pivotal impeller wheel, and/or, by providing additional identical radial fixing grooves in the hydraulic working spaces of the pivotal impeller wheel, alternatively to fix them in one or more position(s) between its two end positions if particular operating states of the internal combustion engine so require.

A further feature according to the invention of the first embodiment of a sealing strip locking system is that the radial fixing groove in the inside of the lateral wall of the drive wheel remote from the camshaft has a length approximately corresponding to the height of the sealing strip simultaneously configured as a locking element and is configured to be slightly recessed over part of its length by a further pressure medium guide groove, the non-recessed parts of the groove floor of the radial fixing groove being provided as axial stop surfaces of the sealing strip in its coupling position. The width of the radial fixing groove, approximately corresponding to the thickness of the lockable sealing strip, is also so dimensioned that not only is easy sliding of the sealing strip into the fixing groove possible but also flapping of the sealing strip in its coupling position is prevented, and the lateral surfaces of the fixing groove act as stop surfaces for the lockable sealing strip in both directions of rotation of the impeller wheel. In order further to facilitate the sliding of the sealing strip into the radial fixing groove, it is also advantageous additionally to chamfer or round off the lateral surfaces of the sealing strip or alternatively, as an equivalent measure, to configure the fixing groove to be slightly conical in profile or to round off its edges. Similarly, it is advantageous to make the lateral wall of the drive wheel remote from the camshaft wear-resistant, at least in the region of the radial fixing groove, in order to counteract the wear phenomena of the radial fixing groove that necessarily occur as a result of continuous locking and unlocking of the device and the disadvantages resulting therefrom, such as flapping of the sealing strips in their coupling position or the like. This can be done particularly advantageously, in the case of a device consisting of ferritic materials, by partial hardening of the region of the radial fixing groove or by hardening of the whole lateral wall of the drive wheel remote from the camshaft, suitable coatings or surface treatments also being possible here. In the case of a device produced in the lightweight manner, in other words consisting of non-ferritic materials, by contrast, this can be effected in that the region of the radial fixing groove is formed by a separate, prefabricated insert component in the lateral wall of the drive wheel remote from the camshaft, which consists of a wear-resistant material such as, for example, a hardened steel or the like.

The pressure medium guide groove within the radial fixing groove is also hydraulically connected at its end facing the longitudinal central axis of the device, via a pressure medium transverse groove machined in the lateral wall of the drive wheel remote from the camshaft, to a pressure chamber of the hydraulic working space of the drive wheel divided by the blade with the locking element. Through the pressure medium transverse groove, the hydraulic pressure medium passes, starting from an annular channel in the wheel hub of the pivotal impeller wheel, via a pressure medium feed line leading to the respective pressure chamber into the pressure medium guide groove within the radial fixing groove, so that the pressure acting on the part of the lateral surface of the sealing strip that is not resting on the stop surfaces of the fixing groove in the coupling position of the sealing strip, and is thus configured as a pressure impact surface, effects an axial displacement of the sealing strip into its uncoupling position if a particular pressure value is exceeded. It has also proven advantageous in this connection if the delimitation walls of the drive wheel or the blades of the pivotal impeller wheel each possess pressure medium pockets configured as free incisions at their stop surfaces defining the locking position of the device, which accelerate the filling of the respective first pressure chambers to be subjected first to the action of pressure by a pressure medium with the device locked in one of the end positions of the pivotal impeller wheel and, by means of a virtually unhindered passing-on of the pressure-medium pressure via the pressure medium transverse groove onto the pressure impact surface of the locked sealing strip, ensure a rapid and reliable axial displacement of the sealing strip into its uncoupling position.

Finally, in the design according to the invention of the first embodiment of a sealing strip locking system, it is further proposed that two helical compression springs or conical springs, each disposed within an axial basic bore in the lateral surface of the sealing strip facing the camshaft, are provided as the spring element for the axial movement of the sealing strip configured as a locking element into its coupling position and are each disposed within their basic bores to enclose a rivet-like guide pin which is in sliding spot contact with the inside of the lateral wall of the drive wheel facing the camshaft. These guide pins possess, at their ends facing the camshaft, a cross-sectional thickening which can be recessed in their basic bores in the uncoupling position of the sealing strip and by means of which the spring means can be supported at one end on the floor of the basic bore and at the other at the transition surface to this cross-sectional thickening. To reduce the friction between the guide pins and the lateral wall of the drive wheel during the adjustment operation, it is also advantageous to configure the end surface of each guide pin facing the camshaft in a convex manner and in hardened form. Similarly, it has proven advantageous to configure the guide pins, preferably, with a through bore along their longitudinal central axis, which provides pressure compensation and serves for easier displacement of hydraulic pressure medium present in the basic bores during the movement of the sealing strip into its uncoupling position.

In addition to the axial locking, described above, between the impeller wheel and the drive wheel by means of a sealing strip on a blade of the pivotal impeller wheel, in an alternative development of the invention there is also proposed, as a second embodiment of a sealing strip locking system, using the radially movable arrangement of the sealing strips in the axial grooves in the end surfaces of the blades of the pivotal impeller wheel in such a way that the sealing strip simultaneously configured as a locking element is in the coupling position in positive engagement, by its sealing surface oriented toward the lateral wall of the drive wheel in one or more locking position(s) of the device, with, in each case, one axial fixing groove configured as a complementary seating in the inside of the lateral wall of the drive wheel. In this embodiment also is has proven sufficient if the sealing strip simultaneously configured as a locking element is in latching connection with the drive wheel in only one locking position of the device, this locking position likewise corresponding to one of the two end positions of the pivotal impeller wheel lying on the delimitation walls of the drive wheel. The axial fixing groove of the sealing strip is, accordingly, preferably machined into the peripheral wall of the drive wheel in the vicinity of one of the two delimitation walls of the working space of the drive wheel divided by the blade with the locking element. However, the scope of protection of the invention is also intended to encompass those solutions in which two or more sealing strips are simultaneously configured as locking elements, it being possible for all of these locking elements either to be locked in one end position or alternatively, by providing a further axial fixing groove in the vicinity of the respective other delimitation wall of each hydraulic working space, to be locked in both end positions of the pivotal impeller wheel. Similarly, it is also possible here to configure one or more sealing strips to be latchable in one end position and one or more sealing strips to be latchable in the other end position of the pivotal impeller wheel, and/or, by providing additional identical axial fixing grooves in the hydraulic working spaces, alternatively to fix the pivotal impeller wheel in one or more position(s) between its two end positions if particular operating states of the internal combustion engine so require. In order to avoid, in this embodiment also, the wear phenomena of the axial fixing groove that necessarily occur and the disadvantages resulting therefrom, it is likewise advantageous to configure the peripheral wall of the drive wheel to be wear-resistant, at least in the region of the axial fixing groove. This can again be done advantageously in the case of a device consisting of ferritic materials by partial hardening of the region of the axial fixing groove or by hardening of the whole peripheral wall of the drive wheel or, instead, by suitable coatings or surface treatments, while in the case of a device produced in the lightweight manner this can be effected by a separate, prefabricated insert component forming the region of the axial fixing groove, which consists of a wear-resistant material, for example of a hardened steel.

A further feature according to the invention of the second embodiment of a sealing strip locking system is that the sealing surface of the sealing strip simultaneously configured as a locking element is slightly chamfered in the radial direction and is configured as a pressure impact surface of the hydraulic pressure medium for the uncoupling position of the sealing strip, a separate pressure medium feed line being disposed to open into the widening gap between the sealing surface of the sealing strip and the groove floor of the axial fixing groove, this separate pressure medium feed line being hydraulically connected to a pressure chamber of the hydraulic working space divided by the blade with the locking element. The separate pressure medium feed line to the sealing surface of the sealing strip configured as a locking element is in this case, in a preferred embodiment, configured as a unilateral or bilateral edge chamfering of the peripheral wall of the drive wheel which is disposed to extend from the stop surface of one of the delimitation walls of the hydraulic working space divided by the blade with the locking element as far as the axial fixing groove. If the respective pressure chamber is subjected to the action of pressure, therefore, the hydraulic medium, limited by the lateral walls of the drive wheel, flows along this edge chamfer to the chamfered sealing surface of the sealing strip located in the axial fixing groove and effects a radial displacement of the sealing strip into its uncoupling position if a particular pressure value is exceeded. As an alternative embodiment, however, it is also possible to configure the separate pressure medium feed line to the sealing surface of the sealing strip as a pressure medium guide groove machined into the inside of the peripheral wall of the drive wheel, which likewise begins in the immediate vicinity of the stop surface of one of the delimitation walls of the hydraulic working space divided by the blade with the locking element and opens into the axial fixing groove.

In a design according to the invention of this second embodiment of a sealing strip locking system, finally, it is also proposed that the supporting spring of the sealing strip, preferably configured as a chimney spring or leaf spring, is provided as the spring element for the radial movement of the sealing strip configured as a locking element into its coupling position and is disposed to be supported at one end on the groove floor of the axial groove for the sealing strip in the free end surface of the blade of the pivotal impeller wheel and at the other end on the end surface of the sealing strip facing the groove. Should its spring travel or spring force prove inadequate here, it is also possible, at least for the sealing strip configured as a locking element, to use helical compression springs or other suitable spring elements recessed both into the groove floor of the axial groove in the blade and into the end surface of the sealing strip facing the groove, or alternatively to provide a plurality of different spring elements connected in series.

The device according to the invention for varying the valve control times of an internal combustion engine, especially a camshaft adjusting device, thus comprises the advantage compared with device known from the prior art, in both the embodiments described, that as a result of the dual function of a sealing element between the pivotal impeller wheel and the drive wheel as a simultaneous locking element only a minimum of additional individual components and additional effort in the production of the device are required in order to be able to effect locking of the pivotal impeller wheel relative to the drive wheel in one or more position(s) relative to one another. As a result, the device according to the invention advantageously differs from the known devices in requiring an enormously favorable material expense and production effort, so that the production costs of a camshaft adjusting device with such a locking system are increased only insignificantly by comparison with a camshaft adjusting device without a locking system.

BRIEF DESCRIPTION OF THE DRAWINGS

The invention will be described below with reference to two examples of embodiment. In the appended drawings.

DETAILED DESCRIPTION OF THE DRAWINGS

Figure 1A:
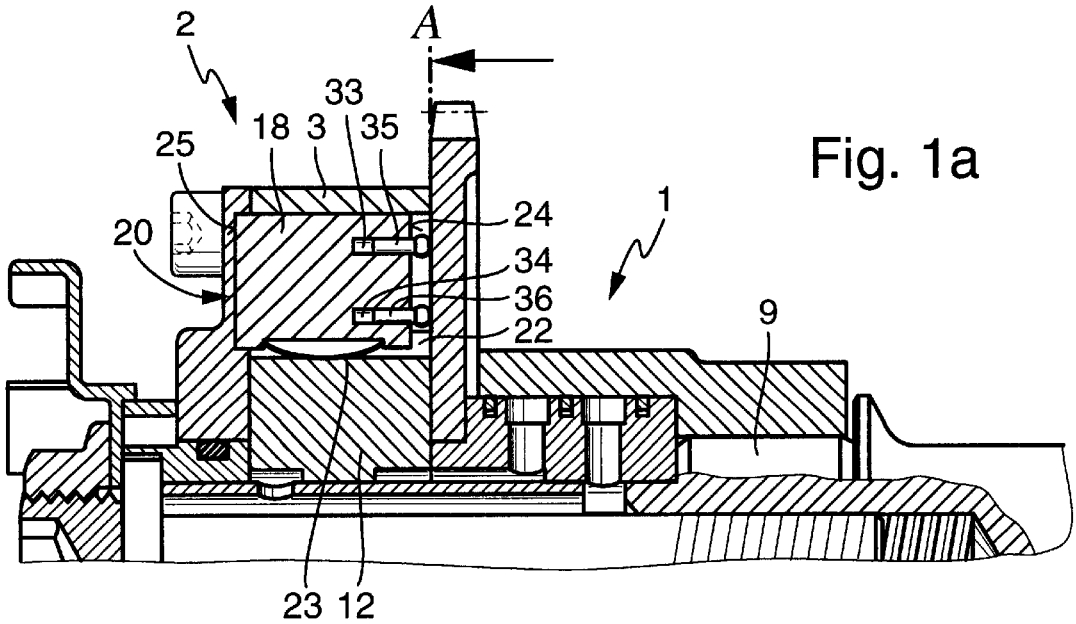
FIG. 1*a* shows the upper part of a cross section through a first embodiment of a camshaft adjusting device configured according to the invention.
Figure 1B:
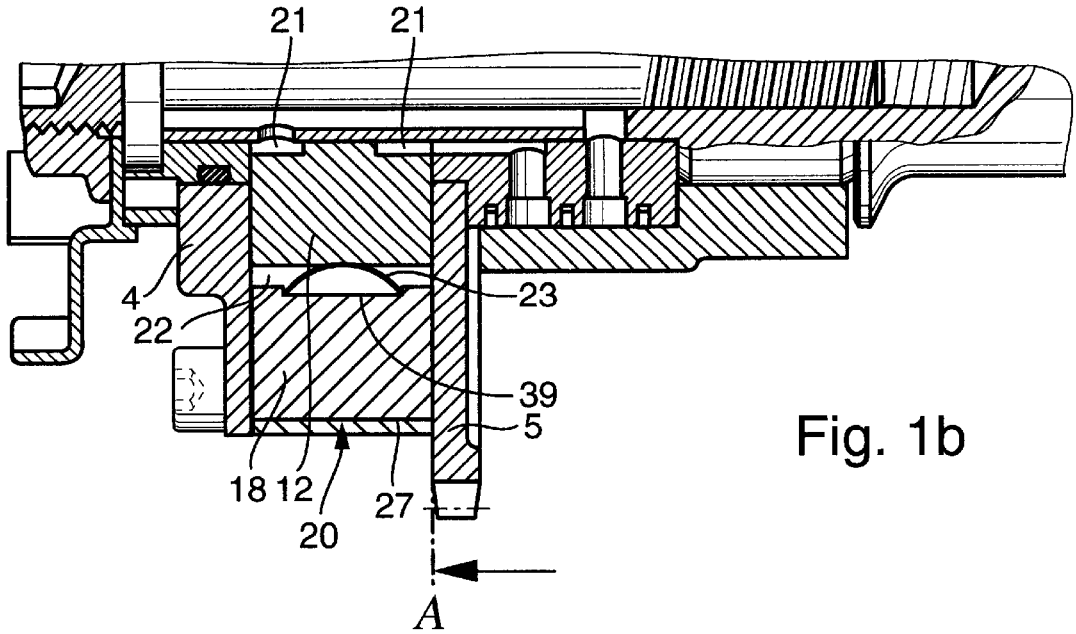
FIG. 1*b* shows the lower part of a cross section through a second embodiment of a camshaft adjusting device configured according to the invention.
Figure 2A:
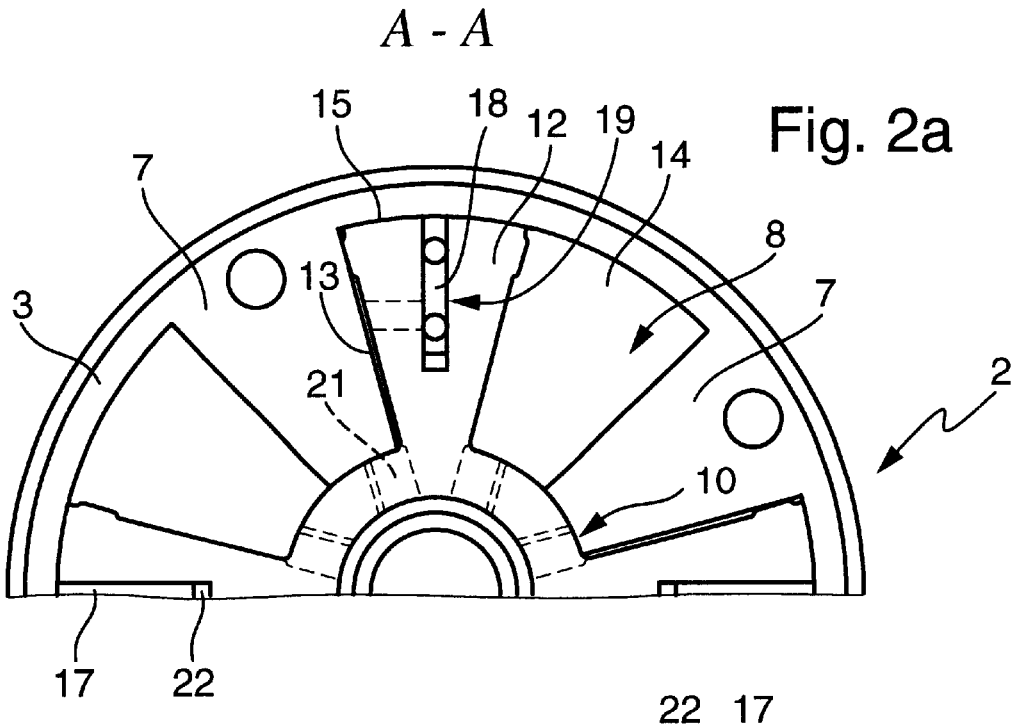
FIG. 2*a* shows the upper part of the section A—A in accordance with FIGS. 1*a* and 1*b* with the first embodiment of the camshaft adjusting device configured according to the invention.
Figure 2B:
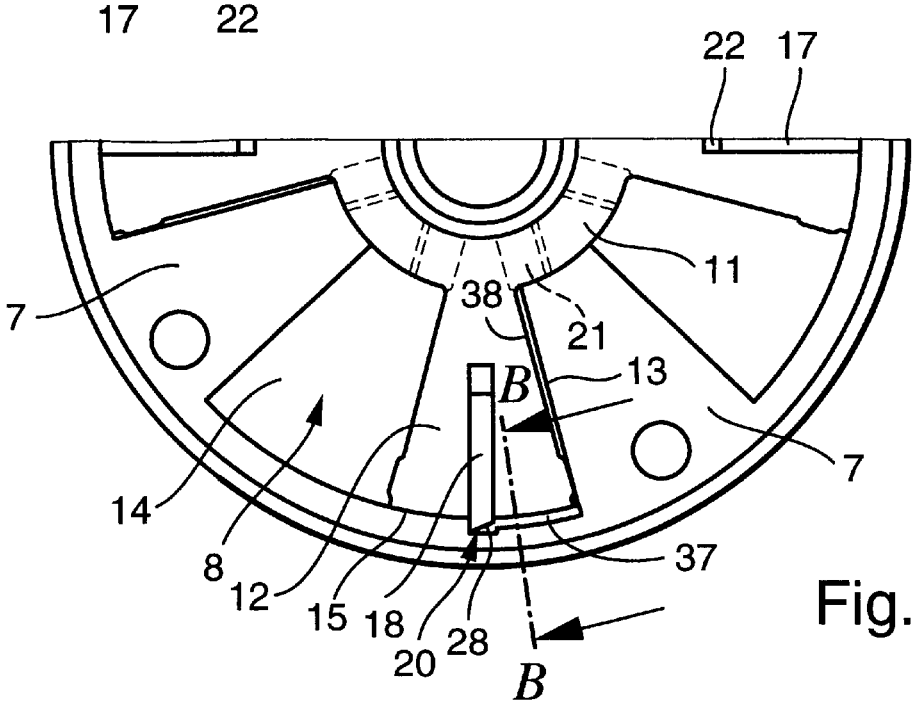
FIG. 2*b* shows the lower part of the section A—A in accordance with FIGS. 1*a* and 1*b* with the second embodiment of the camshaft adjusting device configured according to the invention.
Figure 3:
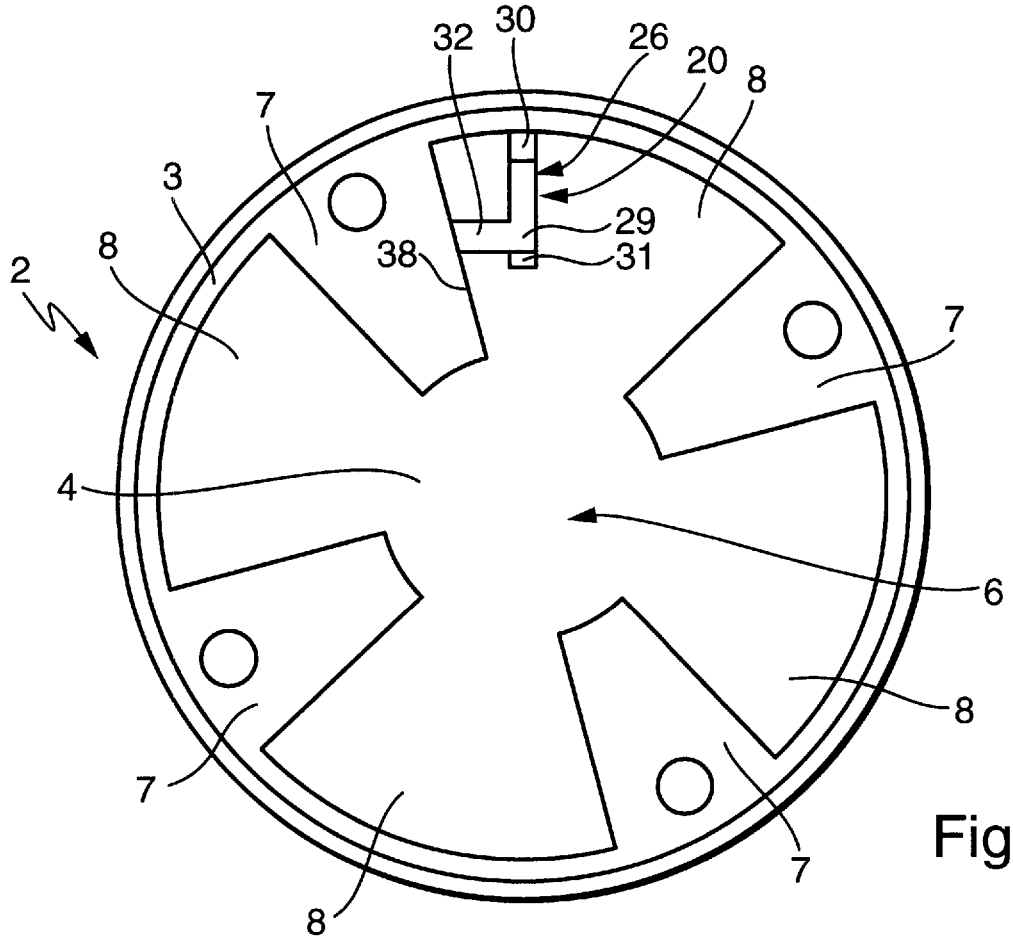
FIG. 3 shows a plan view of the lateral wall remote from the camshaft of the first embodiment of the camshaft adjusting device configured according to the invention.

FIGS. 1*a* and 1*b* and FIGS. 2*a* and 2*b* clearly show a device 1, configured as a pivotal impeller wheel adjusting device, for varying the valve control times of an internal combustion engine, which comprises a drive wheel 2 configured as an outer rotor and drive-connected to a crankshaft (not shown) of the internal combustion engine and of a pivotal impeller wheel 10 configured as an inner rotor and connected in a rotationally fixed manner to a camshaft 9 of the internal combustion engine. It is also apparent from FIGS. 1*a* and 1*b*, in conjunction with FIG. 3, that the drive wheel 2 comprises a cavity 6 formed by a peripheral wall 3 and two lateral walls 4, 5, within which cavity four hydraulic working spaces 8 are formed by four delimitation walls 7 starting from the inside of the peripheral wall 3 and oriented toward the longitudinal central axis of the drive wheel 2. FIGS. 2*a* and 2*b* additionally show that the pivotal impeller wheel 10 likewise comprises four blades 12 disposed on the periphery of its wheel hub 11 and is inset into the cavity 6 of the drive wheel 2 in such a manner that each blade 12 extends into a working space 8 of the drive wheel 2 and divides the latter into pairs of hydraulic pressure chambers 13, 14 working in opposition to one another. Clearly visibly here, the pressure chambers 13, 14 are sealed off from one another by sealing elements 17 disposed between the free end surface 15 of each blade 12 of the pivotal impeller wheel 10 and the peripheral wall 3 of the drive wheel 2 so that the pressure chambers 13, 14, if selectively or simultaneously subjected to the action of pressure by means of a hydraulic pressure medium, effect a pivot movement or fixing of the pivotal impeller wheel 10 relative to the drive wheel 2.

A further feature of the device 1 shown in the drawings is that after the internal combustion engine is switched off, its pivotal impeller wheel 10 can be mechanically coupled to the drive wheel 2, with a change of volume of the pressure chambers 13, 14 of each hydraulic working space 8, in a preferred basic position for the starting of the internal combustion engine, the device 1 illustrated being configured, by way of example, as a pivotal impeller wheel adjusting device mounted on an input camshaft, whose pivotal impeller wheel can be mechanically coupled to the drive wheel, with minimization of the volume of a pressure chamber 13, in the basic position shown in FIGS. 2*a* and 2*b* and corresponding to a "late position" of the camshaft 9. In the device 1 according to the invention shown, this mechanical coupling is effected in that at least one of the sealing elements 17 between the pivotal impeller wheel 10 and the drive wheel 2 of the device 1 is simultaneously configured as a locking element 18. In this context, it can be clearly seen in the drawings that the sealing elements 17 for sealing off the pressure chambers 13, 14 of the device 1 are configured as sealing strips disposed in each case within an axial groove 22 in the free end surface 15 of each blade 12 of the pivotal impeller wheel 10 and configured to be radially movable via supporting springs 23, and having an axial length corresponding to the width of the peripheral wall 3 of the drive wheel 2 and a radial height corresponding to approximately half the length of a blade 12 of the pivotal impeller wheel 10. Each of these sealing strips 17 configured as a locking element 18 is then movable in a conventional manner by a sprint element 19 into a coupling position within a complementary seating 20 in the drive wheel 2, which is hydraulically connected to the pressure medium feed 21 to a volume-minimized pressure chamber 13 of a hydraulic working space 8 of the device 1 in a manner such that when the internal combustion engine is started, as a result of the subjection to the action of pressure of the volume-minimized pressure chamber 13 of each hydraulic working space 8 the seating 20 is simultaneously subjected to the action of pressure and the sealing strip configured as a locking element 18 is moved hydraulically into an uncoupling position.

In a first embodiment of the device configured according to the invention, shown in FIGS. 1*a* and 2*a*, this is achieved in that only one sealing strip simultaneously configured as a locking element 18 is additionally axially movable in a manner such that, in the coupling position, it is in positive engagement, by its lateral surfaces 25 oriented toward the lateral wall 4 of the drive wheel 2 in only one locking position of the device 1, corresponding to the abovementioned "late position" of the camshaft 9, with a complementary seating 20. It is apparent here from FIG. 3 that the complementary seating 20 is configured as a radial fixing groove 26, which is disposed in the vicinity of the delimitation wall 7 of the working space 8 of the drive wheel 2 divided by the blade 12 with the locking element 18 and is machined into the lateral wall 4 of the drive wheel 2 remote from the camshaft to extend radially to the longitudinal axis of the device 1. Similarly, it can be clearly seen that the radial fixing groove 26 has a length approximately corresponding to the height of the sealing strip simultaneously configured as a locking element and is configured to be recessed over part of its length by a further pressure medium guide groove 29, which opens at its end facing the longitudinal central axis of the device 1 into a pressure medium transverse groove 32 machined in the lateral wall 4 of the drive wheel 2 remote from the camshaft. This radial fixing groove 26 is configured to be wear-resistant by partial hardening of the lateral wall 4 of the drive wheel 2 remote from the camshaft, the non-recessed parts of the groove floor of the radial fixing groove 26 being provided as axial stop surfaces 30, 31 of the sealing strip in its coupling position. The pressure medium guide groove 29 is moreover hydraulically connected via the pressure medium transverse groove 32 extending as far as the stop surface 38 of the delimitation wall 7 to the pressure chamber 13, volume-minimized in the coupling position of the pivotal impeller wheel 10, of the hydraulic working space 8 of the drive wheel 2 in order to be able to uncouple the locking element 18 hydraulically, as described initially.

Two helical compression springs, each disposed within an axial basic bore 33, 34 in the lateral surface 24 of the sealing strip facing the camshaft, are provided as the spring element 19 for the axial movement of the sealing strip configured as a locking element 18 into its coupling position and are each disposed within their basic bores 33, 34 to enclose a guide pin 35, 36 which is in sliding spot contact with the inside of the lateral wall 5 of the drive wheel 2 facing the camshaft. These guide pins 35, 36 possess, at their ends facing the camshaft, a cross-sectional thickening which can be recessed in their basic bores in the uncoupling position of the sealing strip and by means of which the helical compression springs can be supported at one end on the floor of the basic bores 33, 34 and at the other at the transition surface to this cross-sectional thickening.

Figure 4:
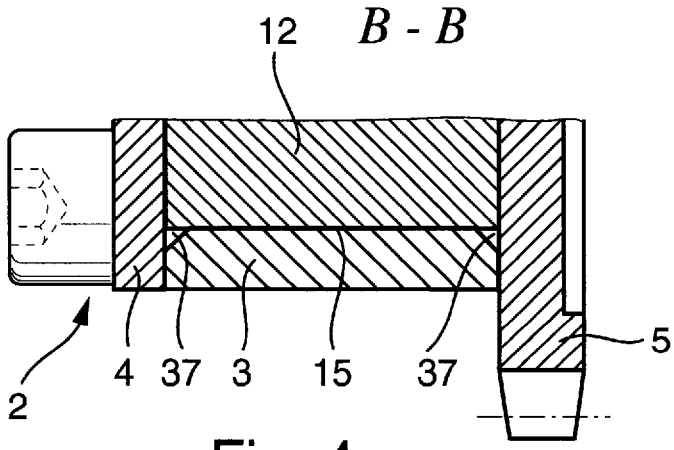
FIG. 4 shows the enlarged partial section B—B in accordance with FIG. 2*b* through the peripheral wall of the second embodiment of the camshaft adjusting device configured according to the invention.

In a second embodiment of the device 1 according to the invention, shown in FIGS. 1*b* and 2*b*, by contrast, the radially movable arrangement of the sealing strips 17 in the axial grooves 22 in the end surfaces 15 of the blades 12 is used in such a way that, again, only one sealing strip simultaneously configured as a locking element 18 is, in the coupling position, in positive engagement, by its sealing surface 27 oriented toward the peripheral wall 3 of the drive wheel 2 in, again, only one locking position of the device 1, with a complementary seating 20. As is apparent from FIGS. 2*b* and 4, in this embodiment the complementary seating 20 is configured as an axial fixing groove 28, which is machined in the vicinity of the delimitation wall 7 of the hydraulic working space 8 into the inside of the peripheral wall 3 of the drive wheel 2 divided by the blade 12 with the locking element 18 and is configured to be wear-resistant by partial hardening of the peripheral wall 3 of the drive wheel 2. FIG. 2*b* also indicates that the sealing surface 27 of the sealing strip simultaneously configured as a locking element 18 is slightly chamfered in the radial direction and is configured as a pressure impact surface of the hydraulic pressure medium for the uncoupling position of the sealing strip. A separate pressure medium feed line 37 opens here into the widening gap between the sealing surface 27 of the sealing strip and the groove floor of the axial fixing groove 28, this separate pressure medium feed line 37, as is more clearly apparent from FIG. 4, being configured as a bilateral edge chamfer of the peripheral wall 3 of the drive wheel 2. As a result of this edge chamfer, extending from the stop surface 38 of one delimitation wall 7 of the hydraulic working space 8 to the axial fixing groove 28, the axial fixing groove 28 is again hydraulically connected to the volume-minimized pressure chamber 13 of the hydraulic working space 8 divided by the blade 12 with the locking element 18, so that the hydraulic uncoupling of the locking element 18 described initially is ensured.

The spring element 19 for the radial movement of the sealing strip configured as a locking element 18 into its coupling position is, in this second embodiment of the device 1 according to the invention, formed by the supporting spring 23 of the sealing strip indicated in FIG. 1*a*, which in the specific case is configured as a leaf spring and is supported at one end on the groove floor of the axial groove 22 for the sealing strip and at the other end on the end surface 39 of the sealing strip facing the groove.

What is claimed is:

1. A device for varying the valve control times of an internal combustion engine, especially a camshaft adjusting device with a pivotal impeller wheel, having the following features:

1.1 the device (1) comprises a drive wheel (2) configured as an outer rotor and drive-connected to a crankshaft of the internal combustion engine, which drive wheel (2) comprises a cavity (6) formed by a hollow cylindrical peripheral wall (3) and two lateral walls (4, 5), 1.2 within the cavity (6) of the drive wheel (2) at least one hydraulic working space (8) is formed by two delimitation walls (7) starting from the inside of the peripheral wall (3) and oriented toward the longitudinal central axis of the drive wheel (2), 1.3 the device (1) further comprises a pivotal impeller wheel (10) configured as an inner rotor and connected in a rotationally fixed manner to a camshaft (9) of the internal combustion engine and inset into the cavity (6) of the drive wheel (2), 1.4 the pivotal impeller wheel (10) has on the periphery of its wheel hub (11) at least one radially disposed blade (12), which extends into a working space (8) of the drive wheel (2) and divides the latter into pairs of hydraulic pressure chambers (13, 14) working in opposition to one another, 1.5 the pressure chambers (13, 14) are sealed off from one another by sealing elements (17) disposed at least between the free end surface (15) of each blade (12) of the pivotal impeller wheel (10) and the peripheral wall (3) of the drive wheel (2), 1.6 the sealing elements (17) are preferably configured as sealing strips disposed in each case within an axial groove (22) in the free end surface (15) of each blade (12) of the pivotal impeller wheel (10) and radially movable via supporting springs (23), 1.7 the pressure chambers (13, 14), when selectively or simultaneously subjected to the action of pressure by means of a hydraulic pressure medium, effect a pivot movement or fixing of the pivotal impeller wheel (10) relative to the drive wheel (2) and hence of the camshaft (9) relative to the crankshaft, 1.8 when the internal combustion engine is switched off, the pivotal impeller wheel (10) can be mechanically coupled to the drive wheel (2), with a change of volume of the pressure chambers (13, 14) of each hydraulic working space (8), in a preferred basic position for the starting of the internal combustion engine, 1.9 the mechanical coupling is effected by a locking element (18) disposed on the pivotal impeller wheel (10) or on the drive wheel (2) and movable by a spring element (19) into a coupling position within a complementary seating (20) in the drive wheel (2) or in the pivotal impeller wheel (10), 1.10 the complementary seating (20) of the locking element (18) is hydraulically connected to the pressure medium feed (21) to at least one pressure chamber (13 or 14) of a hydraulic working space (8) of the device (1), 1.11 when the internal combustion engine is started, as a result of the subjection to the action of pressure of a pressure chamber (13 or 14) of each hydraulic working space (8) the seating (20) of the locking element (18) is simultaneously subjected to the action of pressure and moves the latter hydraulically into an uncoupling position, 1.12 at least one of the sealing elements (17) between the free end surface (15) of each blade (12) of the pivotal impeller wheel (10) and the peripheral wall (3) of the drive wheel (2) of the device (1) is simultaneously configured as a locking element (18) for the mechanical coupling of the pivotal impeller wheel (10) to the drive wheel (2) of the device (1), 1.13 the sealing strip simultaneously configured as a locking element (18) in the coupling position is in positive engagement, by its sealing surface (27) oriented toward the peripheral wall (3) of the drive wheel (2) in one or more locking position(s) of the device (1), with, in each case, one axial fixing groove (26) configured as a complementary seating (20) in the inside of the lateral wall (3) of the drive wheel (2).

2. The device as claimed in claim 1, wherein at least the sealing strip simultaneously configured as a locking element having an axial length corresponding to the width of-the peripheral wall of the drive wheel and a radial height corresponding to approximately half the length of a blade of the pivotal impeller wheel.

3. The device as claimed in claim 1, wherein the sealing strip simultaneously configured as a locking element is preferably in latching connection with the drive wheel in only one locking position of the device, its axial fixing groove preferably being machined into the inside of the peripheral wall of the drive wheel in the vicinity of one of the two delimitation-walls of the hydraulic working space of the drive wheel divided by the blade with the locking element.

4. The device as claimed in claim 3, wherein the inside of the peripheral wall of the drive wheel is of wear-resistant, hardened configuration at least in the region of the axial fixing groove, or the region of the axial fixing groove is formed by a separate, prefabricated insert component made from a wear-resistant metal.

5. The device as claimed in claim 1, wherein sealing surface of the sealing strip simultaneously configured as a locking element is slightly chamfered in the radial direction and is configured as a pressure impact surface of the hydraulic pressure medium for the uncoupling position of the sealing strip, a separate pressure medium feed line being disposed to open into the widening gap between the sealing surface of the sealing strip and the groove floor of the axial fixing groove, this separate pressure medium feed line being hydraulically connected to a pressure chamber of the hydraulic working space divided by the blade with the locking element.

6. The device as claimed in claim 5, wherein the separate pressure medium feed line to the sealing surface of the sealing strip configured as a locking element is preferably configured as a unilateral or bilateral chamfering of the peripheral wall of the drive wheel or as a pressure medium guide groove machined into the inside of the peripheral wall and is disposed to extend from the stop surface of one of the delimitation walls of the hydraulic working space divided by the blade with the locking element as far as the axial fixing groove.

7. The device as claimed in claim 1, wherein the supporting spring of the sealing strip, preferably configured as a chimney spring or leaf spring is provided as the spring element for the radial movement of the sealing strip configured as a locking element into its coupling position and is disposed to be supported at one end on the groove floor of the axial groove for the sealing strip in the free end surface of the blade of the pivotal impeller wheel and at the other end on the end surface of the sealing strip facing the groove.

* * * * *